United States Patent [19]

Amano et al.

[11] 4,452,296

[45] Jun. 5, 1984

[54] ALUMINUM-DIFFUSION COATED STEEL PIPE GATING SYSTEM

[75] Inventors: Tomiaki Amano; Tetsuya Eda, both of Kitakyushu; Sunao Nishi, Nagasaki; Shigeyoshi Shichiri, Nagayo; Takayuki Fukunaga, Ariake, all of Japan

[73] Assignees: Hitachi Kinzoku Kabushiki Kaisha, Tokyo; Shinto Kogyo Kabushiki Kaisha, Nagasaki, both of Japan

[21] Appl. No.: 401,975

[22] Filed: Jul. 26, 1982

[30] Foreign Application Priority Data

Jul. 25, 1981 [JP] Japan ..... 56-116551

[51] Int. Cl.[3] ..... B22C 9/08

[52] U.S. Cl. ..... 164/363; 164/138; 164/342; 249/109; 249/135

[58] Field of Search ..... 164/342, 363, 138; 249/109, 135

[56] References Cited

FOREIGN PATENT DOCUMENTS

| | | | |
|---|---|---|---|
| 973325 | 8/1975 | Canada | 164/138 |
| 2823998 | 12/1979 | Fed. Rep. of Germany | 164/363 |
| 55-10372 | 1/1980 | Japan | 164/138 |
| 55-10379 | 1/1980 | Japan | 164/138 |
| 715209 | 2/1980 | U.S.S.R. | 164/138 |

*Primary Examiner*—Gus T. Hampilos
*Assistant Examiner*—J. Reed Batten, Jr.
*Attorney, Agent, or Firm*—Wenderoth, Lind & Ponack

[57] ABSTRACT

An aluminum-diffusion coated steel pipe having an aluminum-coated layer on at least the inner surface of the steel pipe to be in contact with molten metal is used as a gating pipe system in a casting mold comprising a mold body and a gating system for pouring molten metal into the mold body. This aluminum-diffusion coated steel pipe can be further subjected to a secondary heat treatment in a high-temperature oxidizing atmosphere.

6 Claims, 8 Drawing Figures

ALUMINUM-DIFFUSION COATED STEEL PIPE GATING SYSTEM

BACKGROUND OF THE INVENTION

This invention relates to a casting mold having a novel gating pipe system.

As is well known, a casting mold is assembled with a sand mold, a metal mold or the like, and most molds comprise a gating system. The gating system adjacent to a pouring basin can be generally divided into a sprue, a sprue base, a runner and a gate. The sprue is so designed that molten metal corresponding to the weight of a casting is passed through within a predetermined time. The sprue base, runner and gate are so designed that the energy loss due to the fluid resistance of the molten metal is minimized or the molten metal flows through rapidly and gently. By the term "gating pipe system" used herein is meant a system composed of all or some members of the sprue, sprue base, runner and gate.

In general, the gating system for pouring small castings has been molded with sand and coated with a mold coating material to protect the sand surface and ensure its smoothness. The gating system for medium or large castings has been assembled by joining china clay or chamotte pipes 200 to 600 mm in length.

In these conventional gating systems, however, the following problems arise. In view of the quality of castings and problems upon pouring, the wash of sand at a sprue wall, a sprue base and the like or the pipe-melting of china clay or chamotte sprue pipes as shown in FIGS. 6*a* and 6*b* is apt to take place, which results in defective castings in the form of sand inclusion and slag inclusion.

As one of the ways to overcome such defective phenomena, castings with machining allowance for receiving the above mentioned inclusions can be produced and then machined to remove the allowance portions. This method, however, results in a decrease in the product yield and a higher cost of the products due to additional man-hours. Moreover, when the extent of wash of sand and pipe-melting is great, leakage of the molten metal and/or clogging of the runner takes place, whereby the pouring operation becomes impossible.

From the viewpoint of molding operations and molding man-hours, even when it is desired to install the runner and gate at ideal positions according to a mold design, such positions are restricted because the china clay or chamotte sprue pipes must be joined and are subject to the lengths of pipes and the shapes of joints. Moreover, in order to fix these pipes and to prevent breakage due to the collision of the molten metal and thermal impact upon pouring or due to the static pressure of the molten metal, a metal frame of cast iron is generally used and the space between the pipes and metal frames is filled with sand containing a binder which is then firmly hardened by ramming. In the course of the ramming operation, shift, breakage and the like of the pipes at the joint portions take place to lower the operation efficiency and also to cause leakage of the molten metal. Thus, in order to prevent shift and breakage and decrease the molding man-hours, development of a single and longer gating system has been urgently needed. At present, such a single gating system of only about 600 mm or less has been provided, because of various problems such as the difficulty in the production, breakage in transportation and high cost.

When sand having a large degree of freedom is used, great skill and a great number of man-hour for the molding are required, and also the risk of the above described wash of sand and sand inclusion is increased. To solve these problems, the china clay or chamotte sprue pipes have come into use, which in turn have given rise to new problems as described above.

We have carried out extensive research for providing novel casting molds to solve the prior art problems, as summarized below.

First, we conducted pouring experiments, using a steel pipe sprue as disclosed in Japanese Utility Model Laid-Open Publication No. 67007/1973 and Utility Model Publication No. 21205/1974 instead of conventional china clay pipes, for the purpose of solving the problems of the molding operations and man-hours. The steel pipe used was a carbon steel pipe (Japanese Industrial Standards Designation STK30) 50A (outer diameter 60.5 mm, wall thickness 2.3 mm), and 800 kgs of molten ductile cast iron was used. In FIG. 2 of said Utility Model Laid-Open Publication No. 67007/73, it is stated that the wall thickness of steel pipe is 3.0 mm for 200 kgs of molten cast steel, the temperature of which is estimated to be about 200° C. higher than the temperature for pouring molten ductile cast iron (1,340° C.) used in the present experiment. Thus, we presumed that a steel pipe can be used as the sprue.

In the present experiment, the sprue portion was dismembered after casting and cooling, and inspected. In spite of a pouring time of only 35 seconds, the sprue steel pipe had been melted to a degree such that its original shape was not retained at all, and a large degree of metal penetration was observed in the sand around the sprue. Thus, it has been found that a steel pipe is not suitable at least as a sprue.

This is considered to be due to the following reasons. Because the carbon concentration in ductile cast iron is as high as about 15 times that of the steel pipe, the carbon is diffused from the molten metal into the sprue steel pipe material, that is, the steel pipe material is carburized. As a result, the melting point of the steel pipe material is lowered. It is considered that the steel pipe underwent rapid pipe-melting because of the synergistic actions of the carburizing phenomenon and the erosive action by the molten metal stream.

Then, a refractory such as $Al_2O_3$ powder was applied as a coating on the inner surface of the steel pipe for the purpose of preventing the carburizing phenomenon, and the above described experiment was repeated.

This coating treatment was conducted by using a commercial mold coating material (trade names Ceramol 55 and Okamold) according to the methods described in Japanese Patent Publication Nos. 7911/59 and 8808/59 to produce a coat thickness of about 0.2 to about 1.0 mm. In all of these cases, pipe-melting was observed. This is considered to be due to the reasons that the carburizing phenomenon could not be prevented because the coated steel pipe was subject to thermal impact upon pouring of the molten metal, a remarkable difference in the thermal expansions between the refractory-coated layer and the steel pipe body, and erosive action by the molten metal stream, and the refractory-coated layer was peeled off to expose the steel pipe surface. In this connection, sprues and the like made of refractory-coated steel pipes which can withstand the above described conditions practically without peeling off and pipe-melting have not yet been developed as commercial products.

On the other hand, as a method for improving the antioxidation property at high temperatures of steel materials, a treatment method of coating the surface thereof with diffused aluminum has been known. The Al-diffusion coating treatment method comprises, for example, embedding a steel material to be treated such as steel pipes in an aluminum cementation agent containing a mixture of Al powder with $Al_2O_3$ powder or other powder materials and an accelerator such as ammonium chloride which has been packed in an unsealed metal vessel such as an iron chamber, and then heating these materials to a temperature of 850° to 1,050° C. for 10 to 25 hours.

By such a treatment, the diffusion cementation of aluminum into the steel material takes place and an Al-coated layer consisting essentially of an Fe-Al alloy layer is formed on the surface layer of the steel material. When the resulting coated steel material is subjected to secondary heating in a high-temperature oxidizing atmosphere (for example, when the diffusion-coated steel material is heated upon use in contact with molten metal, or is further exposed to an oxidizing atmosphere at 800° to 1,000° C. for 10 to 120 minutes), an aluminum-coated layer consisting of a dense firm $Al_2O_3$ film formed on the outer surface and an Fe-Al alloy layer adjoining thereto is obtained. In the secondary thermal treatment, aluminum in the Fe-Al alloy layer is selectively oxidized rather than iron therein to form the $Al_2O_3$ layer. The thin dense $Al_2O_3$ film formed on the outer surface serves to inhibit invasion of oxygen atoms and prevent oxidation of the steel material.

After fundamental experiments, we have found that, instead of the conventional china clay or chamotte sprue pipes, the above described Al-diffusion coated steel material or the coated and further secondary heat-treated steel material is an optimum material for the sprue pipe system, which eliminates the wash of sand as well as the pipe-melting in the course of pouring of molten metal, and an effective casting mold can be provided by utilizing a steel material thus-treated.

SUMMARY OF THE INVENTION

In accordance with the present invention, there is provided a casting mold comprising a mold body and a metallic gating pipe system for pouring molten metal into the mold body, characterized in that the gating pipe system is an Al-diffusion coated steel pipe having an Al-coated layer at least on a side of the steel pipe surface to be in contact with the molten metal.

An $Al_2O_3$ film formed on the surface of the Al-coated steel according to the present invention has less affinity (wettability) with respect to the molten metal. Thus, the pipe-melting in the course of pouring of molten metal does not take place, and the steel material can be effectively protected from the erosive actions due to the molten metal.

The nature, utility, and further features of this invention will be more clearly apparent from the following detailed description beginning with a consideration of general aspects of the invention and concluding with specific examples of practice thereof and comparative examples.

Figure 7:
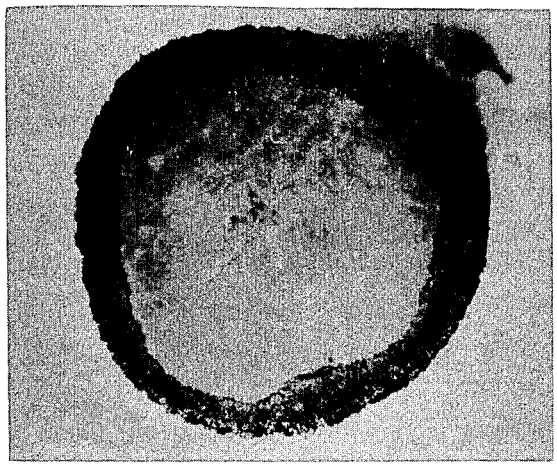
FIG. 7 PRIOR ART

FIG. **6*a*** is a photograph showing the state of the pipe-melting in the conventional china clay sprue pipe used in Comparative Example 1;

FIG. **6*b* is a photograph showing the inner surface of the same china clay sprue pipe; and FIG. 7** is a photograph showing a cross-section of a sprue using a carbon steel pipe described in Comparative Example 2.

DETAILED DESCRIPTION OF THE INVENTION

Figure 5:
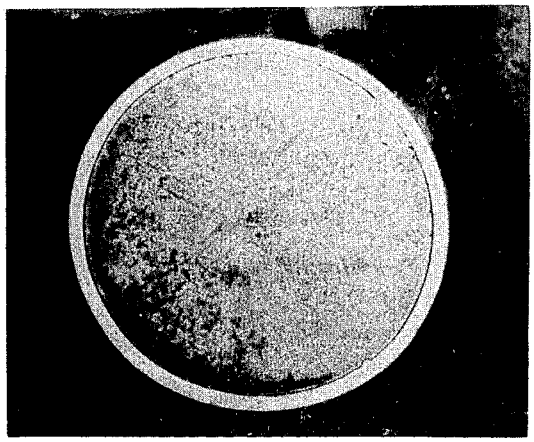
FIG. 5 is a photograph showing a cross-section of a used sprue portion after pouring and cooling as described in Example 1 of the present invention.

With reference to FIG. 5 which is a photograph showing a cross section of a lower portion of the sprue in Example 1 set forth hereinafter, a black line showing a gap can be clearly observed between the sprue pipe and the metal therein. The width of this line was confirmed under microscopic observation to be 0.05 to 0.15 mm. The presence of this gap indicates a low degree of affinity (wettability) mentioned above.

Because the $Al_2O_3$ film has a density such as to prevent oxygen atoms from permeating, a metal atom having a far larger atomic radius as well as a carbon atom having a somewhat larger radius than oxygen cannot infiltrate through the $Al_2O_3$ film. It is considered that the above described carburizing phenomenon is thus prevented. Moreover, in the Al-diffusion coating treatment of high carbon steel, a concentrated zone of carbon is produced in the vicinity of the interface between the alloy layer and the steel material. This indicates that carbon does not form a solid solution with the Fe-Al layer, whereby it is considered that the presence of this layer also serves to prevent the carburizing phenomenon.

Furthermore, as is clear from the fact that $Al_2O_3$ is present as a single impurity, $Al_2O_3$ does not form a compound with the molten metal and thus can maintain its melting point as high as 2,050° C. to withstand the erosive action due to the poured metal.

The metallurgical adhesion having such desirable properties between the $Al_2O_3$ film and the Fe-Al layer as well as the Fe-Al layer and the steel material provides the resistance against the erosive and abrasive actions due to the poured metal, prevents self-disintegration due to the thermal impact upon pouring and the difference in thermal expansions of each layer, and thus acts effectively as a protecting film.

As the metallic pipes in the present invention, various steel pipes can be used among which those made of carbon steel, alloy steel, stainless steel and heat-resisting steel are especially preferred. Examples of suitable carbon steel pipes are carbon steel pipes for general structural purposes designated as STK 30 and 41 by the Japanese Industrial Standards (JIS), carbon steel pipes for high temperature service designated as STPT 38 and 42, and steel conduit tubes of material designated as SPHT 1. Examples of alloy steel pipes are those designated as STPA 12 and 22 and alloy steel pipes for structural purposes designated as STKS 1 and 2, respectively by JIS. Preferred stainless steel pipes include austenitic stainless steel pipes designated as SUS 304 and stainless steel pipes for structural purposes. Steel pipes formed from heat-resisting steel castings designated as SCH 11 and 12, respectively by JIS, can also be used. The cross section of the metallic pipe used in the present invention is not limited to that of a circular shape but can be of any other shape such as an ellipse.

In the casting mold of the present invention, the gating pipe system and especially its surfaces to be in contact with molten metal are composed of the above described steel material treated with the Al-diffusion coating treatment. The present invention will now be further described in detail with reference to the drawings.

Figure 1:
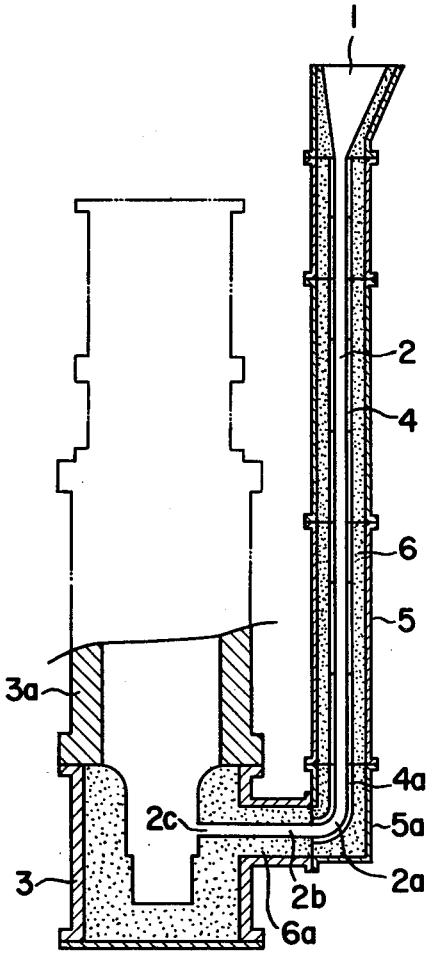
FIG. 1 PRIOR ART
FIG. 1 is an elevation, in vertical section, of a mold for pouring rolls with a gating system of a conventional construction.

FIG. 1 shows an example of a mold for pouring rolls using a conventional china clay sprue-pipe. The molten metal poured from a pouring basin 1 is introduced via a sprue 2, a sprue base 2*a*, a runner 2*b* and a gate 2*c* into mold bodies 3, 3*a*. The sprue 2 and sprue base 2*a* are made by joining eight straight china clay sprue pipes 4 and a J-shaped china clay sprue pipe 4*a* and are housed in heavy metal frames 5, 5*a* having a thicker wall thickness. The intermediate portions thereof are filled with sand 6 containing a binder and generally referred to as back sand, which is hardened by ramming. During the ramming, shift and breakage are apt to take place at the pipe joints. Furthermore, the metal frame cannot be made in a single and long gating system because of the ramming operation and difficulty in handling. The mold and gating system of this example require many man-hours of labor.

The portions of the runner 2*b* and gate 2*c* cannot be made of china clay pipe because they may be broken during the ramming operation, because china clay pipe is difficult to process and has a small degree of freedom although the shapes of these portions are especially important, and because the sand 6*a* becomes contaminated with fragments and lowered in quality when the mold is dismantled. Accordingly, these portions are molded from the sand 6*a* and coated with a mold coating material, but still wash of sand and scab are apt to occur.

Figure 2:
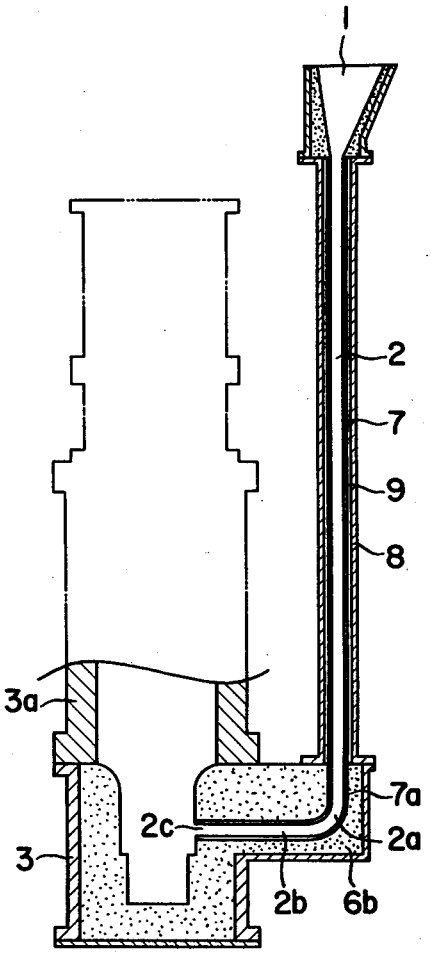
FIG. 2 is a similar elevation, in vertical section of a mold according to the present invention for pouring rolls used in Example 1.

FIG. 2 shows a mold for pouring rolls and its gating system of Example 1, which embodies the technical principle and features of the present invention. In this example, the gating system comprises a straight Al-diffusion-coated pipe 7 of the single long gating pipe system constituting the sprue 2, and a J-shaped Al-diffusion-coated pipe 7*a* integrally constituting the sprue base 2*a*, runner 2*b* and gate 2*c*. The above mentioned Al-diffusion-coated pipe 7 is reinforced on the outside by a light reinforcing steel pipe 8, and the J-shaped Al-diffusion-coated pipe 7*a* is embedded in sand 6*b*. In this case, the sprue 2 of the present invention is reinforced by the light reinforcing steel pipe 8, instead of the conventional heavy metal frame of great wall thickness as shown in FIG. 1, and also does not need to use the back sand which surrounds and fixes the Al-diffusion-coated pipe.

As described above, the sprue pipe 7 composed of the Al-diffusion coated pipe is protected against the breakage due to thermal impact and the pipe-melting due to erosion and normally does not require the use of the back sand and the heavy metal frame of great wall thickness as required in the conventional gating systems. However, the sprue pipe 7 is heated by great quantity of heat of the molten metal and may be deformed because of a decrease in its strength. Accordingly, some reinforcing material such as a steel pipe 8 is sometimes required to reinforce the sprue pipe. In this case, by providing between the sprue pipe 7 and the steel pipe 8 a gap 9 of an order such that these pipes can be separated when they are disassembled, the steel pipe 8 can be used repeatedly. Although not shown in the figure, spacers may be provided between the pipe 7 and pipe 8 at the upper and lower portions of the sprue, depending on the necessity.

In the case of small castings requiring a shorter pouring time or the case of a shorter sprue length, the sprue 2 may be constituted without the reinforcing steel pipe 8, whereby the gating system is further simplified.

In short, the casting mold of the present invention thus realizes an ideal mold sought in the art, upsetting the common but mistaken belief that the sprue must be constructed with back sand.

According to the present invention, the production of defective castings which is caused by the breakage of china clay pipes, pipe-melting and wash of sand, which have been problems in the conventional art, is prevented. Also, the use of a single long gating pipe system without back sand and heavy thick-wall metal frame results in simplification of the molding operations, that is, a remarkable decrease in the molding man-hours of labor.

Moreover, the runner and the like can be installed at an ideal position from the viewpoint of the molding design, because of greater freedom in the molding operations afforded by the nature of the Al-diffusion coated pipe whereby it can be readily cut, and can be bent and welded by heating with a gas burner or the like.

Further, the materials used can be reused as an iron source together with the gating pipe system cast-embedded, as they are without breaking them as in the case of conventional china clay or chamotte pipes, whereby economy in labor and the iron source is realized. Various other advantages can be realized in that the mold sand does not deteriorate, being free of contamination by fragments.

Figure 3:
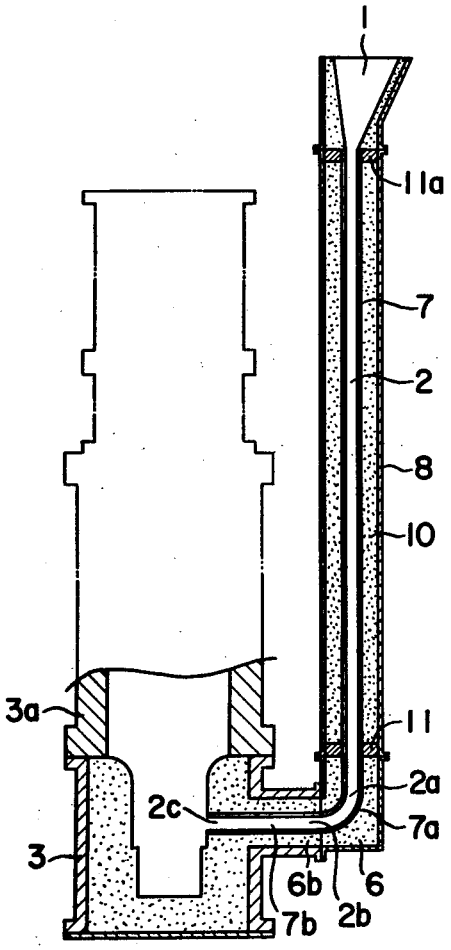
FIG. 3 is a similar elevation, in vertical section of a mold of the present invention for pouring rolls used in Example 2.
Figure 4:
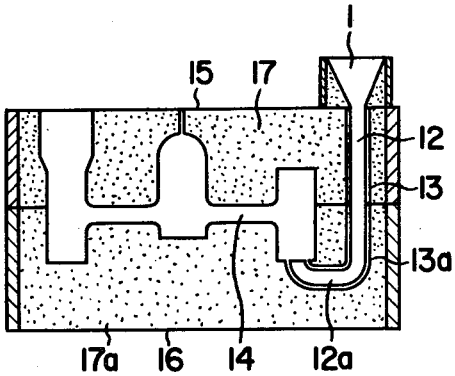
FIG. 4 is an elevation, in vertical section of a mold for pouring a wheel according to Example 3 of the present invention.

As other embodiments of the present invention, the molding designs of Examples 2 and 3 are shown in FIGS. 3 and 4, respectively.

FIG. 3 shows another embodiment of the present invention for pouring a relatively large roll. In this case, sand 10 containing no binder is interposed between an Al-diffusion-coated sprue pipe 7 and a reinforcing steel pipe 8, whereby the decrease in strength of the sprue pipe 7 at a high temperature is compensated for. The gating system is formed with a sprue pipe 7, a J-shaped pipe 7*a* and a runner pipe 7*b*. In this construction, supporters 11 and 11*a* are refractory molded articles used for connecting the J-shaped pipe 7*a* and the sprue pipe 7 as well as the sprue 7 and the pouring basin 1, and also act as spacers between the reinforcing steel pipe 8 and the sprue pipe 7.

Thus, the sand 10 does not need to be solidified with a binder and also does not require a special quality of sand. The reinforcing action can be obtained merely by causing used sand or shore sand to flow down into the mold. According to the present invention, the cost for producing the mold is remarkably decreased because such troublesome operations as assembling a heavy thick-wall metal frame and hardening sand by ramming are eliminated, and also the labor for handling and transportation of heavy materials is decreased. In the present invention, back sand is not generally required at all as shown in FIG. 2 when the Al-diffusion coated pipe is used as the gating pipe system. The present invention also includes the case where back sand is used as in FIG. 3. Even when back sand is used, however, the sand does not require a binder and its quality does not present a problem as described above. Thus, the present invention contributes several advancements to the art.

FIG. 4 shows an example of a mold for a cast steel wheel. In this mold, the gating pipe system 12 and 12*a* was constructed by embedding a straight Al-diffusion coated pipe 13 for the upper mold 15 and the same J-shaped pipe 13*a* for the lower mold 16 in sand 17 and 17*a*. Numeral 14 designates the wheel body.

Thus, the present invention solves such problems encountered in the conventional art as breakage at molding, sand inclusion in castings and contamination of sand with fragments during dismantling which were observed in conventional gating systems using chamotte pipes and sand molds.

The present invention has been described essentially with respect to molds using an Al-diffusion coated pipe in the sprue. Because the shapes of castings are complicated and widely varied, a conventional mold having an ideal runner and the like composed of sand was heretofore often washed and found to be impracticable. By replacing the conventional portions subject to severe conditions with Al-diffusion coated pipes of suitable shapes according to the present invention, a mold having an ideal runner and the like can be obtained in which wash of sand is completely prevented and the risk of sand inclusion is eliminated.

In order to indicate more fully the nature and utility of this invention, the following specific examples of practice thereof and comparative examples are set forth, it being understood that these examples are presented as illustrative only and are not intended to limit the scope of the invention.

EXAMPLE 1

A cast iron roll was cast according to a mold design for pouring the roll for a rolling mill. The pouring conditions were as follows.

As-cast size of roll barrel: 500 mm in diameter, 1,600-mm length.

Quantity of molten metal poured: 3,100 kgs.

Chemical composition (%) of molten metal:

| C | Si | Mn | P | |
|---|---|---|---|---|
| 3.27 | 0.91 | 0.55 | 0.075 | |
| S | Ni | Cr | Mo | Fe |
| 0.024 | 2.60 | 0.98 | 0.11 | remainder |

Temperature for pouring: 1,350° C.

Time for pouring: 2 minutes 30 seconds

Al-diffusion coated pipe: 60.5-mm outer diameter 2.3-mm wall thickness.

Outer steel pipe: 76.3-mm outer diameter, 4.5-mm wall thickness.

The Al-diffusion coating treatment was conducted according to the powder method, which comprises placing carbon steel pipes (STK 30), a cementation agent containing Al powder as the essential component, and a cementation accelerator in an iron chamber, and heating these materials for 15 hours in a heating furnace maintained at 1000° C.

After pouring and cooling, the used mold was dismantled. The sprue portions and the like were cut and subjected to inspection. As a result, neither pipe-melting nor leakage of metal was found, and all portions were sound.

By the use of the casting mold of the present invention, no inclusion of the materials such as sand as observed in the conventional art occurred, and furthermore, the cost for molding labor and the like was reduced to about ⅛ in comparison with the conventional process.

COMPARATIVE EXAMPLE 1

Figure 6A:
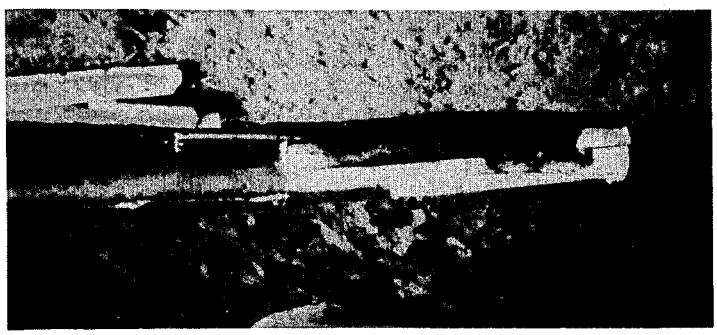
FIG. 6a PRIOR ART
Figure 6B:
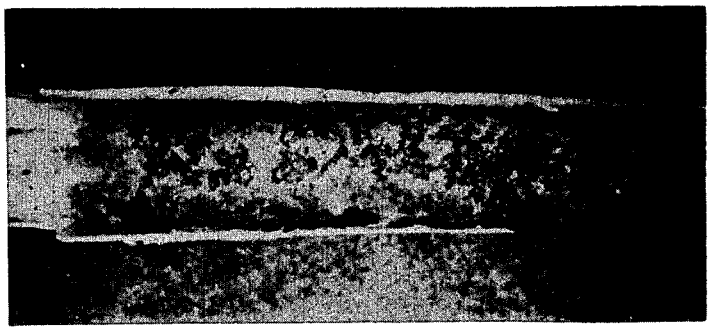
FIG. 6b PRIOR ART

Into the conventional mold for pouring rolls shown in FIG. 1, molten metal of the same chemical composition and temperature as in Example 1 was poured. In this mold, the sprue portions were constructed by joining four china clay sprue pipes 4 (65-mm inner diameter, 15-mm wall thickness, 595-mm length). After the pouring and cooling, the mold was dismantled. The appearance of the sprue 2 is shown in FIG. 6*a*. The china clay sprue pipe did not break and leak metal in the course of pouring of molten metal, but was partly torn off as shown in the upper left part of the photograph. The inside portion of the china clay pipe partly underwent pipe-melting and was bonded to the sprue metal as shown by the white portion in the photograph. FIG. 6*b* shows the inner surface of the china clay pipe after the portion thereof bonded to the sprue metal was torn off. The melted portions of the sprue pipe are shown as black dots. From FIGS. 6*a* and 6*b*, it is clearly seen that the china clay sprue pipe 4 underwent pipe-melting, and the fragments when the mold is dismantled are readily contaminated with the mold sand.

COMPARATIVE EXAMPLE 2

In the casting mold shown in FIG. 1, a mold similar to that shown in FIG. 3 was constructed by replacing the china clay sprue pipe 4 with a carbon steel pipe STK 30 of long length (outer diameter 60.5 mm, wall thickness 2.3 mm) which had not been Al-diffusion coated. Molten metal having the same chemical composition as in Example 1 was poured into the mold under the same conditions as in Example 1. After pouring and cooling, the mold was dismantled. The cross section of the used sprue is shown in FIG. 7. Around the periphery of the cast iron roll material after pouring, the steel pipe as described with respect to FIG. 5 cannot be observed at all, the steel pipe having undergone pipe-melting. A sand-bound layer, which was formed in a manner such that the molten metal for the cast iron roll underwent cementation into the sand originally filled around the steel pipe, is observed on the circumference of the cast roll material.

EXAMPLE 2

A relatively large adamite roll for a rolling mill was cast according to the following casting conditions by using the casting mold of the present invention as shown in FIG. 3. This roll had heretofore been produced by using a mold wherein the gating system was constructed with china clay sprue pipes 4, 4*a* and sand 6*a* as shown in FIG. 1.

In this Example 2, the casting mold was produced by using Al-diffusion coated pipes 7, 7*a*, and 7*b*. Casting Conditions:

As-cast size of roll barrel: diameter 630 mm, length 1,500 mm.

Quantity of molten metal poured: 4,400 kgs.
Chemical composition (%) of molten metal:

| C | Si | Mn | P | |
|---|---|---|---|---|
| 1.75 | 0.70 | 0.81 | 0.021 | |
| S | Ni | Cr | Mo | Fe |
| 0.009 | 0.67 | 1.05 | 0.22 | remainder |

Temperature for pouring: 1,440° C.
Time for pouring: 4 minutes 7 seconds
Al-diffusion coated pipe: outer diameter 63.5 mm, wall thickness 3.2 mm.

After pouring and cooling, the used mold was dismantled and inspected. As a result, no damage whatsoever to the Al-diffusion coated pipes was observed. The cast roll was also sound. The sand could be reused effectively because it is not contaminated by fragments of china clay pipe when dismantled to lower its quality. Moreover, the cost for the molding labor and the like was reduced to about one half in comparison with the conventional process.

EXAMPLE 3

A cast steel wheel was cast according to the mold design of the present invention shown in FIG. 4. The pouring conditions were as follows.
As-cast external size of wheel: outer diameter 800 mm, width 200 mm, thickness 70 mm.
Quantity of molten metal poured: 400 kgs.
Chemical composition (%) of molten metal:

| C | Si | Mn | P | |
|---|---|---|---|---|
| 0.19 | 0.46 | 1.05 | 0.025 | |
| S | Ni | Cr | Mo | Fe |
| 0.016 | 0.14 | 0.04 | 0.04 | remainder |

Temperature for pouring: 1,550° C.
Time for pouring: 48 seconds
Al-diffusion coated pipe: outer diameter 48.6 mm, wall thickness 2.3 mm.

After pouring and cooling, both the cast wheel body and the Al-diffusion coated pipes were found to be sound. Thus, it has been made clear that the Al-diffusion coated steel for the present casting mold can be used for cast steel.

As described above, the casting mold of the present invention is prevented from producing defective castings due to infiltration of matter such as sand. Furthermore, various excellent effects such as a decrease in the production costs are afforded by the present invention, which include, for example, an increase in the freedom of molding operations, decrease in the molding labor, effective utilization of mold sand, and reuse of used materials.

What is claimed is:

1. In a casting mold having a mold cavity therein and a metallic gating pipe system for pouring molten metal into the mold cavity, the improvement in which the gating pipe system comprises an Al-diffusion coated steel pipe having an aluminum-coated layer on at least the surface of the steel pipe to be in contact with the molten metal.

2. The casting mold according to claim 1 in which the Al-coated layer is an Fe-Al alloy layer.

3. The casting mold according to claim 1 further comprising an $Al_2O_3$ surface film on the Al-coated layer.

4. The casting mold according to claim 1 in which the Al-diffusion coated steel pipe is produced by subjecting the steel pipe surface to be in contact with the molten metal to an Al-diffusion coating treatment and then to a secondary heat treatment in a high-temperature oxidizing atmosphere.

5. The casting mold according to claim 4 in which the Al-diffusion coating treatment is carried out by embedding the steel pipe in an aluminum powder cementation agent to be surrounded thereby, the aluminum powder being packed in an unsealed metal vessel, and heating the steel pipe and the aluminum powder.

6. The casting mold according to claim 1 in which the gating pipe system comprises essentially at least one member or a combination of a sprue adjacent to a pouring basin, a sprue base, a runner and a gate.

* * * * *